US008752488B2

(12) United States Patent
Møller

(10) Patent No.: US 8,752,488 B2
(45) Date of Patent: Jun. 17, 2014

(54) HEIGHT ADJUSTABLE TABLE

(75) Inventor: Tommy Møller, Sønderborg (DK)

(73) Assignee: Linak A/S, Nordborg (DK)

( * ) Notice: Subject to any disclaimer, the term of this patent is extended or adjusted under 35 U.S.C. 154(b) by 153 days.

(21) Appl. No.: 12/585,213

(22) Filed: Sep. 8, 2009

(65) Prior Publication Data

US 2010/0126393 A1 May 27, 2010

(30) Foreign Application Priority Data

Sep. 8, 2008 (DK) ..... 2008 01255

(51) Int. Cl.
*A47B 85/00* (2006.01)

(52) U.S. Cl.
USPC ..... 108/20; 108/147.19

(58) Field of Classification Search
USPC ..... 108/20, 147, 147.19, 144.11; 248/161, 248/157, 188, 188.2, 188.5, 651
See application file for complete search history.

(56) References Cited

U.S. PATENT DOCUMENTS

| | | | | |
|---|---|---|---|---|
| 3,385,238 | A * | 5/1968 | Jay | 108/147 |
| 4,714,025 | A * | 12/1987 | Wallin et al. | 108/20 |
| 6,062,148 | A * | 5/2000 | Hodge et al. | 108/147 |
| 6,182,583 | B1 * | 2/2001 | Larson | 108/147 |
| 6,378,816 | B1 * | 4/2002 | Pfister | 248/161 |
| 6,478,269 | B2 * | 11/2002 | Forsberg | 248/188.5 |
| 6,494,005 | B2 * | 12/2002 | Zimmerman | 52/296 |
| 6,509,705 | B2 | 1/2003 | Bastholm et al. | |
| 6,595,144 | B1 * | 7/2003 | Doyle | 108/147 |
| 6,682,030 | B2 * | 1/2004 | Santoro et al. | 248/188.5 |
| 6,883,439 | B1 * | 4/2005 | Moore | 108/147 |
| 6,935,250 | B1 * | 8/2005 | Arnold | 108/147 |
| 7,270,062 | B1 * | 9/2007 | Larson | 108/147 |
| 7,495,359 | B2 * | 2/2009 | Klinke et al. | 310/51 |
| 7,605,239 | B2 * | 10/2009 | Fritzberg | 534/15 |
| 7,908,981 | B2 * | 3/2011 | Agee | 108/147 |
| 8,001,909 | B2 * | 8/2011 | Overgaard et al. | 108/147 |
| 8,011,308 | B2 * | 9/2011 | Picchio | 108/147 |
| 2004/0065239 | A1 * | 4/2004 | Chen | 108/147 |
| 2006/0279143 | A1 * | 12/2006 | Platz et al. | 310/51 |
| 2008/0121150 | A1 * | 5/2008 | Picchio | 108/147.19 |
| 2008/0178779 | A1 * | 7/2008 | Agee | 108/147 |
| 2008/0289544 | A1 * | 11/2008 | Buitmann et al. | 108/20 |
| 2010/0126393 | A1 * | 5/2010 | Moller | 108/147 |
| 2010/0301186 | A1 * | 12/2010 | Chuang | 248/422 |
| 2011/0168064 | A1 * | 7/2011 | Jahnsen et al. | 108/147 |

* cited by examiner

*Primary Examiner* — Daniel Rohrhoff
(74) *Attorney, Agent, or Firm* — Dykema Gossett PLLC

(57) ABSTRACT

A height-adjustable table that includes a table top having first and second ends and two long sides, and at least one table leg at each end, each table leg including a linear actuator with a rectangular motor housing (21) containing an electric motor and a gear. A spindle unit has an upper end is mounted in an opening in the bottom (26) of a rear end of the motor housing and is connected to the gear. Each table leg also includes a telescopic guide (17) with a fixed member (18) and at least one telescopic member (19,20), the telescopic guide surrounding the spindle unit of the actuator and is with one end connected to the bottom (26) of the motor housing (21). The linear actuator is with the motor housing (21) secured to the table top in such a manner that the motor housing (21) with its rear end (22) faces towards a long side (13) and with its front end (23) faces towards the other long side (14) of the table top.

9 Claims, 3 Drawing Sheets

HEIGHT ADJUSTABLE TABLE

BACKGROUND OF THE INVENTION

1. Field of the Invention

The present invention relates to a height-adjustable table where the adjustment of the height is achieved by an electrically driven linear actuator having a substantial rectangular box shaped motor housing with a spindle unit protruding from the housing at a rear end.

2. The Prior Art

The invention departs from the type of height adjustable tables which were introduced on the market in the late 1990s. These tables have a rectangular or a substantially rectangular table top carried by frame work with a telescopic table leg at each end, see, e.g., U.S. Pat. No. 6,509,705 B2 to Bastholm et al. The table legs comprise a telescopic guide with one or two extendable members and an electric linear actuator for effecting the movement. The linear actuator has a substantial rectangular box shaped motor housing containing an electric motor and a gear and further containing a spindle unit, which with an upper end is mounted in an opening in the bottom of the motor housing and is connected to the gear, see, e.g., U.S. Pat. No. 7,495,359 B2 to Klinke et al. The spindle is located at a rear end of the motor housing. The traditional type of table leg is typically provided with a telescopic guide with a rectangular cross section with the dimensions 80 mm×50 mm and a motor housing likewise with a rectangular cross section with the dimensions 96.8 mm×181.4 mm and where the telescopic guide is located across the motor housing such that the broadside (80 mm) of the telescopic guide flushes the rear end (96.8 mm) of the motor housing. The table leg is secured to the supporting frame work for the table top by means of the motor housing, which is arranged along the length of the table top, between longitudinal profiles of the supporting frame work. The profiles are positioned with a mutual distance corresponding to the width of the motor housing and are secured by means of screws into screw holes in the motor housing. The overall frame of the table thus consists of the supporting frame work for the table top, the table legs which with their upper ends are secured to the frame work and a set of feet in which the table legs are secured with their lower end.

The object of the invention is to provide a table with a less complex underframe.

SUMMARY OF THE INVENTION

This is achieved according to the invention with a table where the motor housing is secured to the table top in such a manner that the motor housing with its rear end faces a long side and with its front end faces the other long side of the table top. Thus, the rigidity of the angular or inverted L-shaped leg may be used to provide the rigidity to the table in the transverse direction, which is the far most important. The rigidity in the lengthwise direction of the table is not so crucial. Depending on the specific structure, an actual supporting frame for the table top may even be completely left out, and the table legs may simply be directly fixedly secured to the underside of the table top. In case of, e.g., a table with an angular table top supported by more table legs, these legs may provide stability in different directions as they are mutually angularly positioned relative to each other. If a greater stability is desired in the sideways direction, a longitudinal cross member may be secured to the free end of the outermost telescopic member—i.e., if the outermost telescopic member is secured to the foot, the cross member is secured to the upper end thereof and if the outermost telescopic member is secured to the motor housing, the cross member is secured to the lower end thereof.

Further characteristic features of the invention appear from the claims and the description of an embodiment of the invention below.

BRIEF DESCRIPTION OF THE DRAWINGS

The invention will now be explained more fully below with reference to the accompanying drawings.

DETAILED DESCRIPTION OF THE PREFERRED EMBODIMENTS

Figure 1:
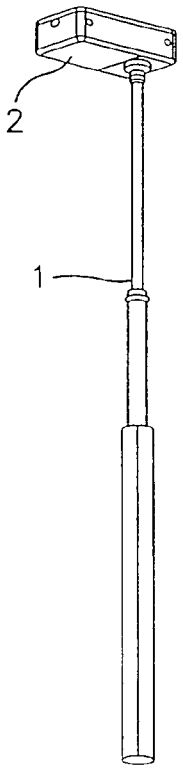
FIG. 1 (PRIOR ART)
FIG. 1 shows a known linear actuator for table legs.

FIG. 1 shows a schematic view of a known linear actuator for an electrically height-adjustable table leg, the linear actuator including a spindle unit 1 driven by a low voltage motor through a transmission. The motor and the transmission are incorporated into a rigid box-shaped housing 2.

Figure 2:
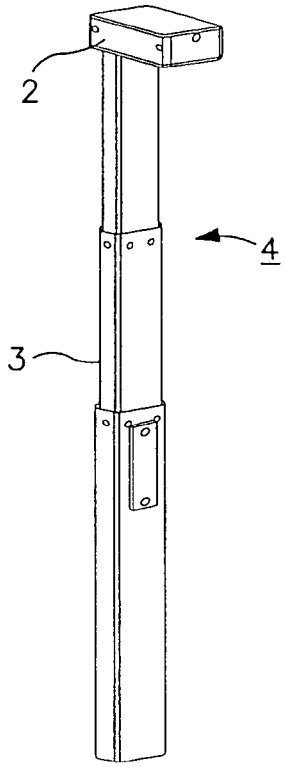
FIG. 2 (PRIOR ART)
FIG. 2 shows a known electrically-adjustable table leg.

FIG. 2 shows a known electrically height adjustable table leg 4 including a guide 3 in the shape of a telescopic cylinder and an incorporated linear actuator of the type identified above, where the housing is secured to the top of the guide 3.

Figure 3:
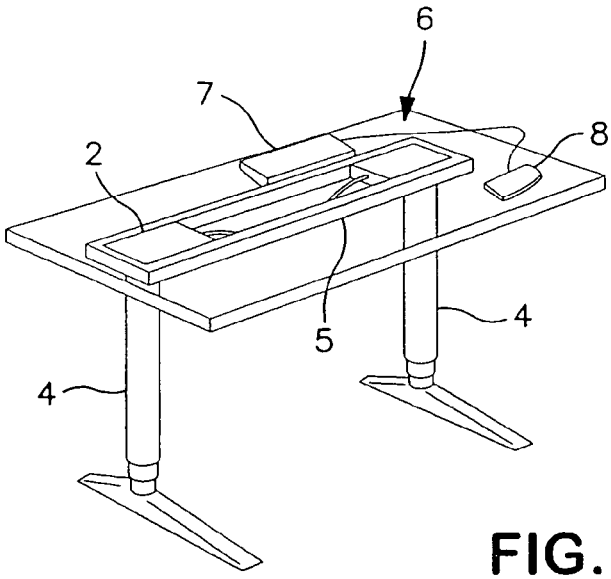
FIG. 3 (PRIOR ART)
FIG. 3 shows a traditionally designed height adjustable table.

FIG. 3 shows a traditional height-adjustable table with electrically height-adjustable table legs 4 of the type identified in FIG. 2, the only difference being that the guide of the legs has a circular cross section instead of a rectangular cross section. The table legs 4 are mounted in supporting frame work 5 in that the supporting frame is screwed onto the sides and one end of the housing by means of screws. The table top 6 which is shown transparent is mounted on the supporting frame work 5 by means of screws. In the drawing, numeral 7 is a control box with a control unit and power supply, while numeral 8 is an operating panel.

Figure 4:
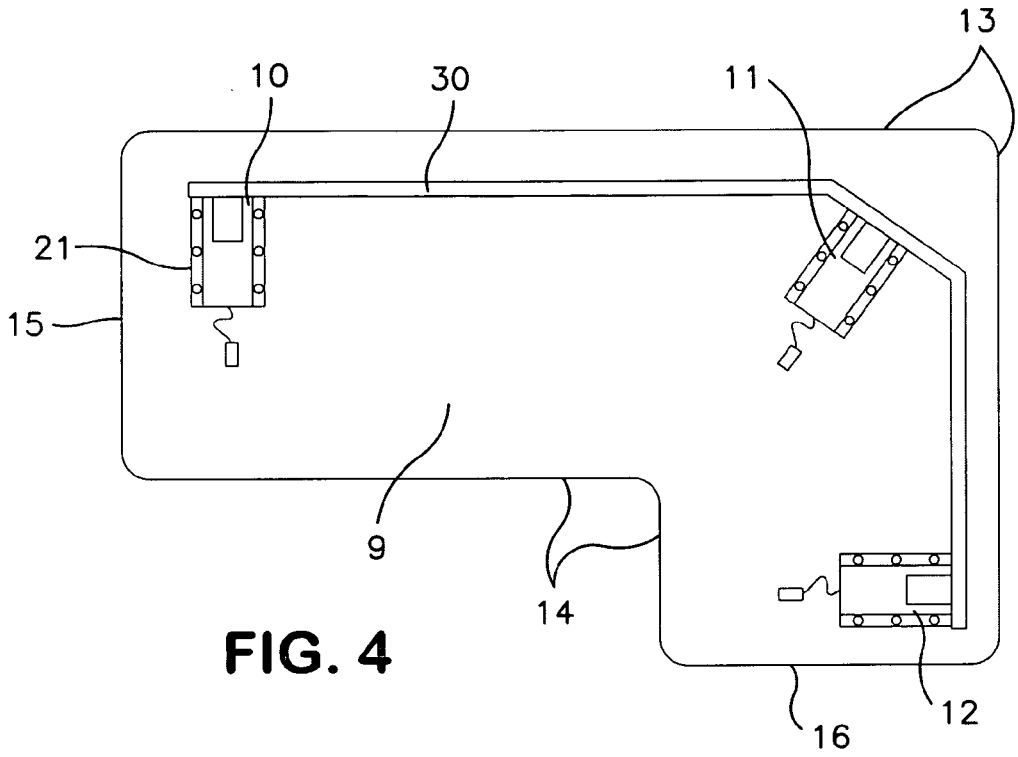
FIG. 4 shows a schematic view of a table seen from above where the table top is shown transparent.

The table shown schematically in FIG. 4 includes of an angular table top 9 with three identical table legs 10,11,12 located at one long side 13 of the table top 9, the long side 13 defining a rear edge of the table. The other long side 14 of the table top 9 defines a front edge of the table and the two ends are indicated with numerals 15,16.

The table legs 10,11,12 consist of a telescopic guide 17 having three members 18,19,20 in the shape of tubes with a rectangular cross section. The table leg is with an innermost member 20 secured to a rectangular box shaped motor housing 21 having a rear end 22, front end 23, a first and second side 24,25, a bottom 26 and a top 27. As it appears, the telescopic guide 17 is secured at the rear end 22 of the motor housing 21 such that the telescopic guide 17 with a narrow side is flush or almost flush with the rear end 13 and such that the longitudinal centre plane of the motor housing and the telescopic guide is coinciding. The upper side of the motor housing 21 is provided with two mounting flanges 28,29 with screw holes as a ninety degree angular bend of the sides 24,25 of the motor housing. Due to this orientation of the motor housing 21 relative to the telescopic guide 17, the table leg has a high stability in the longitudinal centre plane.

The table legs 10,11,12 are fixedly secured directly onto the underside of the table top 9 by means of screws and are located across the table top 9 in such a manner that the table legs 10,11,12 with their rear ends 22 face towards the rear edge 13 of the table and with their front ends 23 facing towards the front edge 14 of the table top. With this orientation a high stability of the table is achieved and with the specific embodiment of the table top stability in the longitudinal direction of the table is also achieved.

To provide further stability in the longitudinal direction of the table, a longitudinal cross member 30 may be mounted which is secured to the upper end of the fixed telescopic guide 18 by means of a cross member bracket 31 as, e.g., disclosed in EP 1 335 139 to Linak A/S.

It is incidentally noted that the motor housing 21 is shown empty without motor, gear and the upper end of the spindle unit. The top 27 of the motor housing will typically be closed with a plate-shaped cover.

Figure 5:
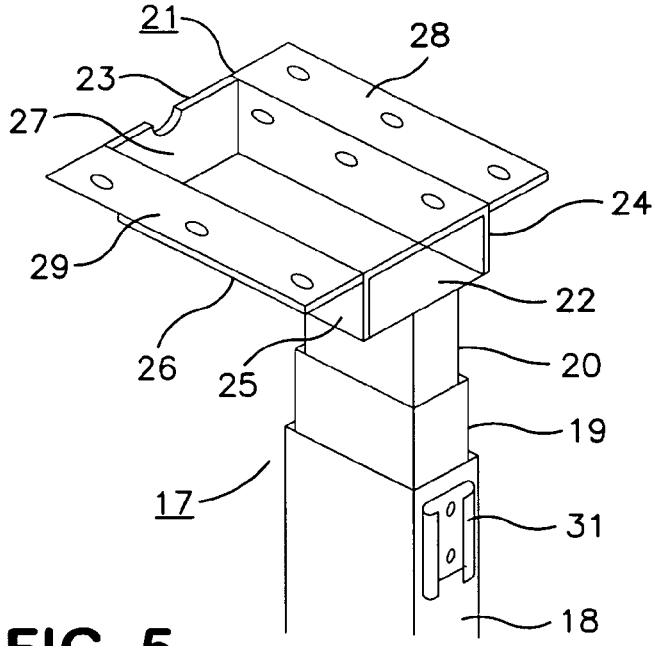
FIG. 5 shows a close view of the upper end of a table leg.
Figure 6:
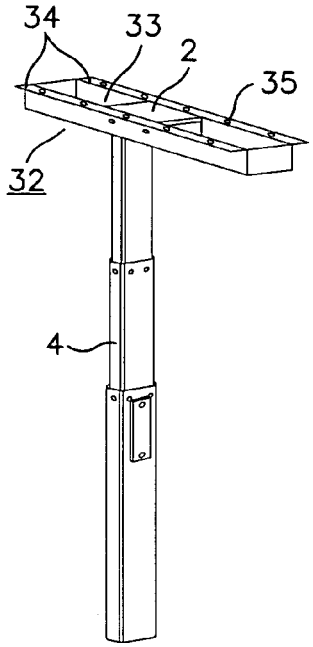
FIG. 6 shows a construction according to the invention.

FIG. 6 shows a construction according to the invention which includes an adaptor unit 32 mounting the known type of table legs 4 as shown in FIG. 2 directly under the table top in a corresponding manner as the table leg shown in FIG. 5. The adaptor unit 32 is designed as a box which is open at the top, the box having an open interior 33 which can accommodate the housing 2 on the table leg 4. The adaptor unit 32 have outwardly bent side edges 34 with screw holes 35 for fastening it by means of screws onto the underside of the table top. The adaptor unit 32 may be fastened to the housing 2 of the table leg 4 in various ways, e.g., in that the adaptor unit 32 has a hollowness into which the housing fits tightly. Alternatively, the housing may be fastened by means of cross walls or flanges on the inside of the adaptor or by means of brackets. Here, the already existing mounting holes in the housing 2 of the table leg 4 may be used.

Figure 7:
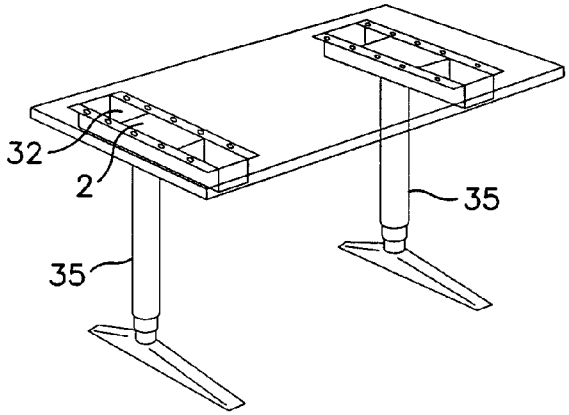
FIG. 7 shows a height adjustable table with a table leg construction according to the invention.

FIG. 7 shows a height-adjustable table with height-adjustable circular legs 35, i.e., the guide has a circular cross section but the legs otherwise being of the type shown in FIG. 5 and furnished with an adaptor 32 as shown in FIG. 6. It is noted that the housing 2 on the legs now faces across the table top.

Figure 8:
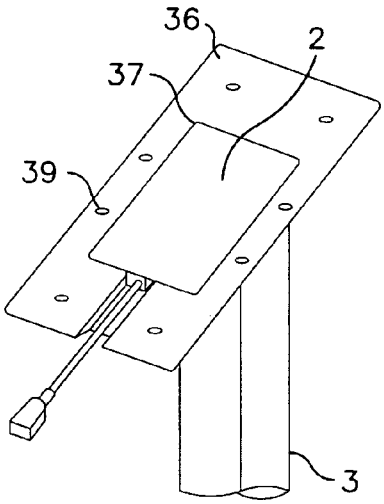
FIG. 8 shows the top of another embodiment of the table leg shown in FIG. 6 seen from above.
Figure 9:
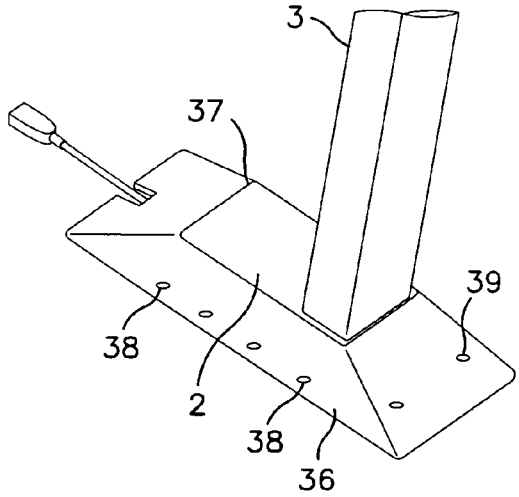
FIG. 9 shows the same as in FIG. 8, but seen from below.

FIGS. 8 and 9 show another embodiment of the table leg shown in FIG. 6, the difference being that the adaptor unit 36 is made of moulded plastic material with a hollowness 37 for receiving the housing 2 of the table leg in a snug fitting manner. The adaptor unit has in the sides horizontal holes 38 aligning the existing screw holes in the housing 2 of the legs such that the adaptor unit could be mounted to the housing by screws. In the sloping side and end walls of the adaptor unit there are screw holes 39 for fixedly securing the adaptor unit and thereby the leg to the table top.

With the invention a table construction is thus provided where actual supporting frame work for the table top is not required.

The invention claimed is:

1. A height-adjustable table comprising:

a table top having first and second ends and first and second long sides, and at least one table leg near each of said ends, each said table leg comprising:

i) a linear actuator including a substantially box-shaped rectangular motor housing with a front end, a rear end, a first side wall, a second side wall, a top, a bottom having an opening near the rear end, and a spindle unit with an upper end mounted in the opening in the bottom of the motor housing, said first and second side walls including first holes for first attachment screws, and ii) a telescopic guide with a fixed member and at least one telescopic member, said telescopic guide surrounding the spindle unit of the actuator and at one end is connected to the bottom of the motor housing, and a generally rectangular adaptor unit in which each motor housing is positioned, each adaptor unit being connected to an underside of the table top such that the rear end of the motor housing faces towards the first long side of the table top and the front end of the motor housing faces towards the second long side of the table top, each adaptor unit being shaped as an elongated open top box with opposite third and fourth side walls and flat flanges extending along said third and fourth side walls, said flat flanges including second holes therein for second attachment screws to attach said adaptor units to an underside of said table top, and third holes in said third and fourth side walls which are aligned with respective first holes for said first attachment screws.

2. The height-adjustable table according to claim 1, wherein each telescopic guide has a rectangular cross section.

3. The height-adjustable table according to claim 2, wherein each telescopic guide defines a narrow side facing the rear end of the motor housing.

4. The height-adjustable table according to claim 3, wherein longitudinal centre planes of each motor housing and each telescopic guide coincide.

5. The height-adjustable table according to claim 1, wherein the table top is angular and a table leg is located at either end of the table top and a table leg is located at an angular region of the table top.

6. The height-adjustable table according to claim 1, wherein said first and second side walls of each motor housing contact the third and fourth side walls of a respective adaptor unit when positioned therein.

7. The height-adjustable table according to claim 1, wherein each adaptor unit has internal cross walls or flanges to which the housing may be secured.

8. The height-adjustable table according to claim 1, including brackets for connecting each housing to a respective adaptor unit.

9. A height-adjustable table comprising:

a table top having first and second ends and two long sides, and at least one table leg near each of said ends, each said table leg comprising:

i) a linear actuator including a substantially box-shaped rectangular motor housing with a front end, a rear end, a first side wall, a second side wall, a top, a bottom having an opening near the rear end, and a spindle unit with an upper end mounted in the opening in the bottom of the motor housing, said first and second side walls including first holes for first attachment screws, and ii) a telescopic guide with a fixed member and at least one telescopic member, said telescopic guide surrounding the spindle unit of the actuator and at one end is connected to the bottom of the motor housing, and a generally rectangular adaptor unit in which each motor housing is positioned, each adaptor unit being connected to an underside of the table top such that the rear end of the motor housing faces towards the first long side of the table top and the front end of the motor housing faces towards the second long side of the table top, each adaptor unit having third and fourth side walls and end walls which slope outwardly and include second screw holes therethrough for attachment to an underside of the table top with second screws, and third holes aligned with said first holes for said first attachment screws.

* * * * *